US006361512B1

(12) United States Patent
Mackay et al.

(10) Patent No.: US 6,361,512 B1
(45) Date of Patent: Mar. 26, 2002

(54) MASSAGING APPARATUS USING INFLATABLE BLADDERS

(76) Inventors: Spencer L. Mackay; Alan D. Crawford; Chris J. Wilson; John R. Petersen; Cleve A. Graham, all of 4940 Vineland Ave., North Hollywood, CA (US) 91601

( * ) Notice: Subject to any disclaimer, the term of this patent is extended or adjusted under 35 U.S.C. 154(b) by 0 days.

(21) Appl. No.: 09/511,283

(22) Filed: Feb. 23, 2000

(51) Int. Cl.[7] ..... A61H 7/00

(52) U.S. Cl. ..... 601/150; 601/152; 601/151; 601/149

(58) Field of Search ..... 601/149, 150, 601/151, 152

(56) References Cited

U.S. PATENT DOCUMENTS

| | | | | | |
|---|---|---|---|---|---|
| 1,813,006 | A | | 7/1931 | White et al. | |
| 3,590,815 | A | * | 7/1971 | Schiff | 128/64 |
| 3,654,919 | A | * | 4/1972 | Birtwell | 128/64 |
| 4,066,084 | A | * | 1/1978 | Tillander | 128/327 |
| 4,068,334 | A | | 1/1978 | Randall | 5/365 |
| 4,614,179 | A | | 9/1986 | Gardner | 128/64 |
| 4,986,260 | A | * | 1/1991 | Iams et al. | 128/24 R |
| 5,245,990 | A | * | 9/1993 | Bertinin | 128/64 |
| 5,341,725 | A | * | 8/1994 | Dick | 92/66 |
| 5,396,896 | A | | 3/1995 | Tumey et al. | 128/690 |
| 5,554,103 | A | * | 9/1996 | Zheng et al. | 601/152 |

* cited by examiner

*Primary Examiner*—Michael A. Brown
*Assistant Examiner*—Benjamin K. Koo
(74) *Attorney, Agent, or Firm*—Jack C Munro

(57) ABSTRACT

A massaging apparatus which utilizes an array of air inflatable bladders. The array is to be located in conjunction with a portion of the body of a human. The array can be mounted within a housing such as a flexible belt-type of device or can comprise a rigid stand-type of device within which is incorporated one or more pockets in order to accommodate a human appendage such as a foot. A separate inflation apparatus is associated with the array which is to supply and extract pressurized air to and from the inflatable bladders. The inflation apparatus utilizes at least one opposed piston assembly so that when one piston is supplying pressurized air to certain bladders the other piston is extracting pressurized air from certain other bladders thereby achieving a sequence of alternating pressurizing and depressurizing which produces a desirable massaging effect on the human body.

13 Claims, 7 Drawing Sheets

MASSAGING APPARATUS USING INFLATABLE BLADDERS

BACKGROUND OF THE INVENTION

1) Field of the Invention

This invention relates to a massaging apparatus for a portion of the body of a human for alternatingly applying and removing pressure to the human body for the purpose of achieving a soothing comfortable massage and as an aid in increasing blood flow and stretching muscle and connective tissue.

2) Description of the Prior Art

Massaging devices for the human body have long been known. One form of a massaging device that has been utilized in the past uses inflatable bladders. Each inflatable bladder is inflated and deflated to replicate a massaging effect when the inflatable bladder is located against the body of a human. Such inflatable bladder massaging devices have been successful at changing the pressure points under a seated or prone patient and also for the purpose of increasing blood circulation by forcing out the blood from an area of the body and thus allowing the capillaries to refill.

In the past, such inflation and deflation of bladders in conjunction with massaging devices have been deemed to be relatively a slow procedure. It would be desirable to have this inflation and deflation to be more rapid which would increase the overall effect of the massaging apparatus and also increase blood circulation. In the past, these inflating massaging devices have been known to use different sets of inflatable cells. When one set of cells is being inflated, a second set of cells is being deflated. In order to achieve this inflation and deflation of different cells, there has been utilized a separate inflation device with control valves for each group of cells. This has greatly complicated the structure that is utilized and has inherently caused the inflation and deflation of the air cells to be at a slower than optimal rate.

Another disadvantage of such prior art inflation/massaging devices is that each of the inflating and deflating strokes do not necessarily pressurize to precisely the same pressure each and every time. This varying of pressure degrades the overall effect of the massaging device.

A still further disadvantage of prior art inflation/massaging devices is that deflation of a cell is accomplished solely by letting the cell leak into the ambient during non-pressurization of the cell. This deflation is slow usually requiring from several seconds to minutes in time. Inflation and deflation should be rapid (approximately one to two seconds) to achieve the most desirable affects.

SUMMARY OF THE INVENTION

The structure of the present invention relates to a massaging device which utilizes a bladder array which includes a series of inflatable bladders. The series of inflatable bladders are divided into a first series and a second series with the first series being inflated when the second series is being deflated, and vice versa. The inflation and deflation is achieved by air being pressurized into one or more bladders during inflation and sucked out of one or more other bladders during deflation. The array may be mounted within a housing which can take numerous forms such as a pad, a flexible wrap or a base member which includes pockets that are to be connectable with a human appendage such as a foot. The inflation device is in the form of an opposed piston assembly which is to be driven by an electric motor, and when the pistons move in one direction, a first series of bladders are inflated and a second series of bladders are deflated. When the piston assembly moves in the opposite direction, the reverse is true. The result is because deflation is occurring in the manner of sucking out the air from the bladders, make rapid inflation and deflation is obtained. The opposed piston design substantially reduces the complexity of the inflation and deflation apparatus. By using two separate opposed piston units there are four pistons with the pistons being located ninety degrees out of phase to even out loading on the motor.

One of the objectives of the present invention is to construct an extremely effective massaging apparatus which utilizes a series of inflatable bladders with the apparatus that is utilized to achieve this inflation and deflation being of simple construction and therefore can be manufactured at a reasonable cost and sold at a reasonable cost to the consumer.

Another objective of the present invention is to use a system for inflation and deflation which achieves rapid inflation and deflation.

Another objective of the present invention is to utilize a simple means to change the pattern of the inflation and deflation procedure within a series of bladders for the purpose of providing a different effect.

DETAILED DESCRIPTION OF THE PREFERRED EMBODIMENTS

Figure 1:
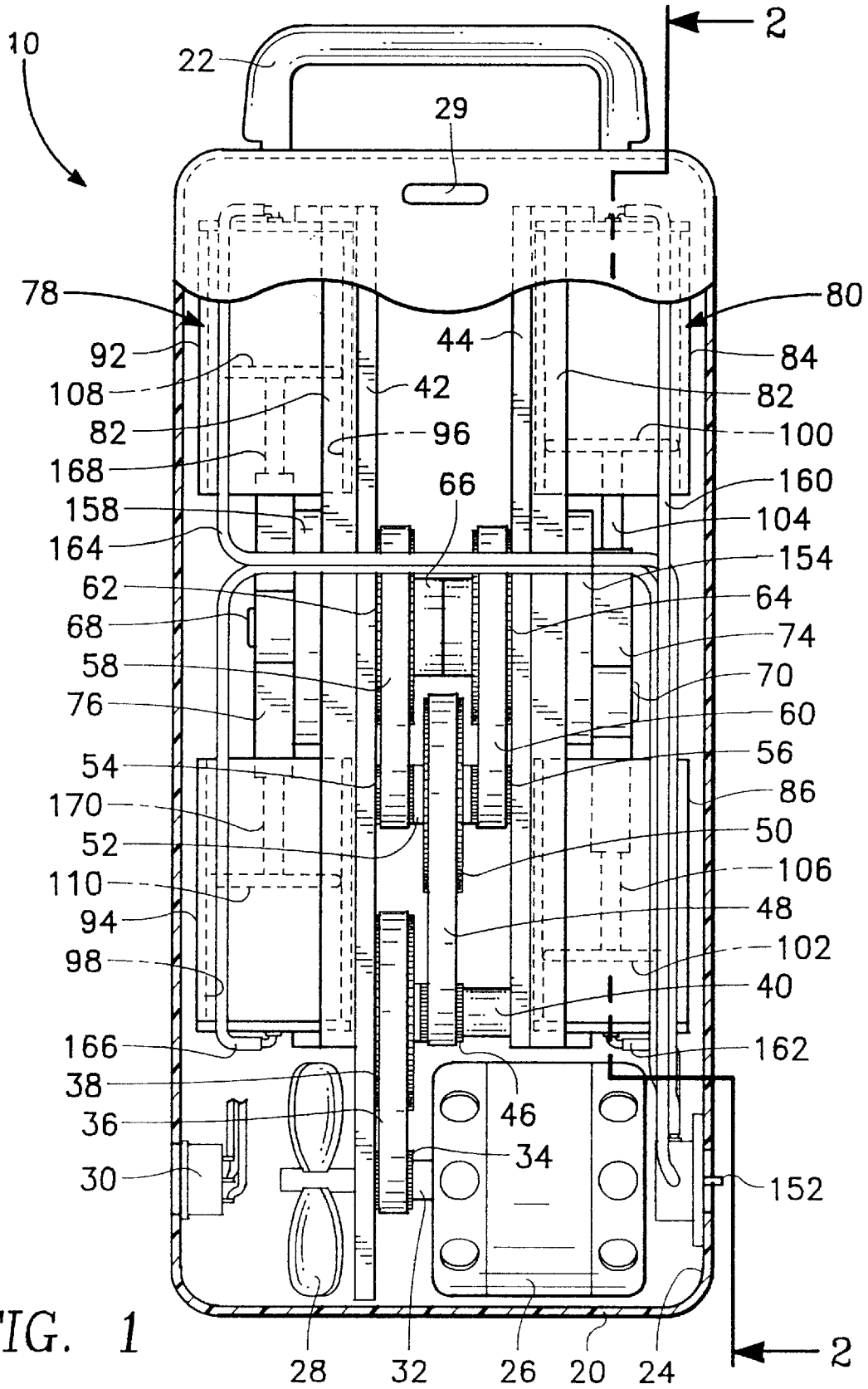
FIG. 1 is a partially cut-away view of an inflation mechanism housing showing the mechanical components that are utilized to achieve inflation and deflation of the massaging apparatus of the present invention.

Referring particularly to FIGS. 1–8 and 16 of the drawings, there is shown a housing 20 that contains the mechanism to achieve the inflation and deflation of the massaging apparatus of the present invention. Mounted on the exterior surface of the housing 20 is a carry handle 22. Normally, this carry handle 22 will be designed to pivot from a stowed position from cavity 21 formed within the housing 20 to a position extended from the housing 20 which is shown in the drawings. The designing of handles 22 so as to be pivotable to out of way positions during non-usage has long been known and does not constitute patentable subject matter in this invention. The housing 20 includes an internal chamber 24. Mounted within the internal chamber 24 is an electric motor 26 which is connected to a cooling fan blade 28. The electric motor 26 is to be electrically connected to a pushbutton switch 29 which is mounted on the housing 20 and located primarily within the internal chamber 24. Electrical power from an exterior source is to be supplied to the electric motor 26 through plug 30. Activation of the switch 29 is to cause turning on and turning off of the motor 26.

The motor 26 has an output shaft 32. Mounted on the output shaft 32 is a pulley 34. Connecting with the pulley 34 is a belt 36. The belt 36 is also connected to a much larger in size pulley 38. The pulley 38 is mounted on a shaft 40 which is rotationally mounted between a pair of mounting plates 42 and 44. The mounting plates 42 and 44 are fixedly mounted to the housing 20 and are located within internal compartment 24.

Mounted on the shaft 40 is a pulley 46 which is much smaller in size than the pulley 38. A belt 48 engages with the pulley 46. The belt 48 also connects to a pulley 50 which is much larger in size than the pulley 46. The pulley 50 is fixedly mounted onto a shaft 52 which is rotationally mounted between the mounting plates 42 and 44. Mounted on shaft 52, between the pulley 50 and the plate 42, is a small sized pulley 54. An identical sized pulley 56 is also mounted on the shaft 52 and located between the pulley 50 and the mounting plate 44. Belt 58 connects with pulley 54. Belt 60 connects with pulley 56. Belt 58 connects with large sized pulley 62. Belt 60 connects with a similar large sized pulley 64. The pulleys 62 and 64 are fixedly mounted onto output shaft 66. One end of output shaft 66 is fixed to a wheel 158 with the opposite end of output shaft 66 being fixed to a wheel 154.

Off center mounted on the wheel 154 is a jack shaft 70. Off center mounted on wheel 158 is a jack shaft 68. Jack shaft 70 is mounted within elongated slot 72 of a crank arm 74. The jack shaft 68 is also mounted within a similar elongated slot, which is not shown, of a crank arm 76. The crank arm 76 is part of an opposed piston unit 78. The crank arm 74 is part of an opposed piston unit 80. The opposed piston units 78 and 80 are basically identical. It is to be understood that once the electric motor 26 is activated that the opposed piston units 78 and 80 would continuously operate with the piston assemblies in each opposed piston unit 78 and 80 reciprocating continuously.

The opposed piston unit 80 includes a channel shaped bar 82. Fixedly mounted between the legs of the channel shaped bar 82 are a pair of cylinders 84 and 86. The cylinder 84 includes an internal chamber 88. The cylinder 86 also includes an internal chamber 90 which is the same configuration as internal chamber 88 and is longitudinally in alignment therewith. In a similar manner, there is a channel shaped bar 82 fixedly mounted onto the mounting plate 42. Fixedly mounted in conjunction between the legs of the channel shaped bar 90 are a pair of cylinders 92 and 94. Cylinder 92 has an internal chamber 96. Cylinder 94 has an internal chamber 98. Again, the internal chambers 96 and 98 are longitudinally aligned. Cylinders 92 and 94 are part of the opposed piston unit 78 and cylinders 84 and 86 are part of the opposed piston unit 80.

Mounted within the internal chamber 88 is a piston 100. Mounted within the internal chamber 90 is a piston 102. Piston 100 is mounted on piston rod 104. Piston rod 104 is fixedly connected to the crank arm 74. The piston 102 is fixedly mounted on piston rod 106. The piston rod 106 is also fixedly mounted to the crank arm 74. In a similar manner, mounted within the internal chamber 96 is a piston 108. A similar piston 110 is mounted within the internal chamber 98. Construction of the pistons 100, 102, 108 and 110 a re all identical. Piston 108 is connected by piston rod 168 to crank arm 76. Piston rod 170 connects piston rod 110 to crank arm 76.

Figure 16:
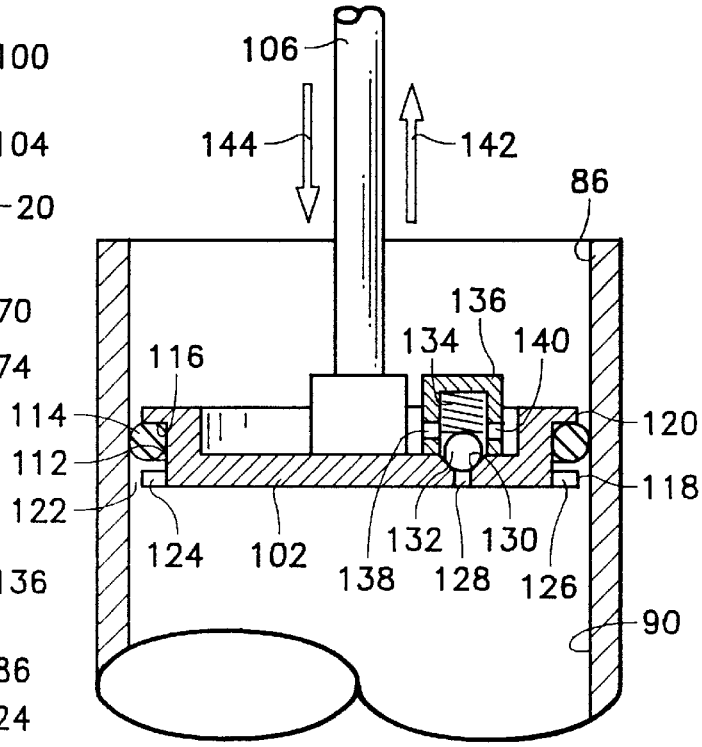
FIG. 16 is an enlarged view of a portion of a piston and cylinder that is used in the opposed piston units included within the massaging apparatus of the present invention.

Referring particularly to FIG. 16, detailed constructional features of the piston 102 is shown with it being understood that pistons 100, 102, 108 and 110 will also he constructed in an identical manner. Piston 102 includes an annular peripheral groove 112. Mounted within the groove 112 is an O-ring 114. It is to be noted that the groove 112 is longitudinally oversized. That is the O-ring 114 is capable of a limited amount of longitudinal movement between a back wall 116 and a front wall 118. Back wall 116 is in the shape of a circular disk and forms a slight space defined as a annular gap 120 with the wall of the internal chamber 90. In a similar manner, the front wall 118 also is basically in the shape of a disk and forms an annular gap 122 relative to the wall surface of the internal chamber 90. The back wall 116 is completely solid and does not include any openings. However, the front wall 118 does include a pair of openings 124 and 126. The function of the openings 124 and 126 will be explained further on in the specification. Generally, the openings 124 and 126 are no more than one-quarter inch wide.

Formed within the body of the piston 102 is a through hole 128. Connecting with the inner surface of the through hole 128 is an annular chamfer 130. The annular chamfer 130 forms a seat for ball 132. The ball 132 connects with a coil spring 134. The coil spring 134 is mounted within a spring housing 136. The spring housing 136 includes a pair of holes 138 and 140.

It is to be understood that the pistons 100, 102, 108 and 110 are movably mounted within their respective internal chambers 88, 90, 96 and 98. During compressive movement of the piston 102 in the direction of arrow 142 within the internal chamber 90, the inherent drag of the wall of the internal chamber 90 against the O-ring 114 will force the O-ring 114 directly against the back wall 116. As pressure begins to build within the internal chamber 90, this pressurized air will be conducted through the openings 124 and 126 to within the groove 112 and apply pressure against the O-ring 114. This causes the O-ring 114 to be squished and form a tighter seal against the wall of the internal chamber 90 preventing escape of the pressurized air past the O-ring 114. The coil spring 134 is preset to an established force so that only upon the pressure within the internal chamber 90 exceeding a predetermined value will the ball 132 be unseated which will permit release of the excess pressure through the through opening 128 to the opposite side of the piston 102 therefore comprising a pressure relief device. The pressurized air, after passing through the through opening 128, is conducted through the holes 138 and 140.

During movement of the piston 102 in the decompressing direction, represented by arrow 144, the O-ring 114 will move away from the back wall 116 when the force of the drag against the wall of the internal chamber 90 exceeds the force of the air pressure being applied against the O-ring 114 from the pressurized air contained within the internal chamber 90. At that point, there will be a created as annular gap 120 which includes the space between O-ring 114 and wall of the internal chamber 90. The annular gap 120 allows air within the internal chamber 90 to return to ambient air pressure. In order to prevent over pressurization from even possibly occurring, and to assure that full pressurization occurs, it is desirable to begin at ambient air pressure that is neither elevated pressure nor vacuum, any time the piston 102 starts to move in the compressing direction which is in the direction of arrow 142.

Figure 2:
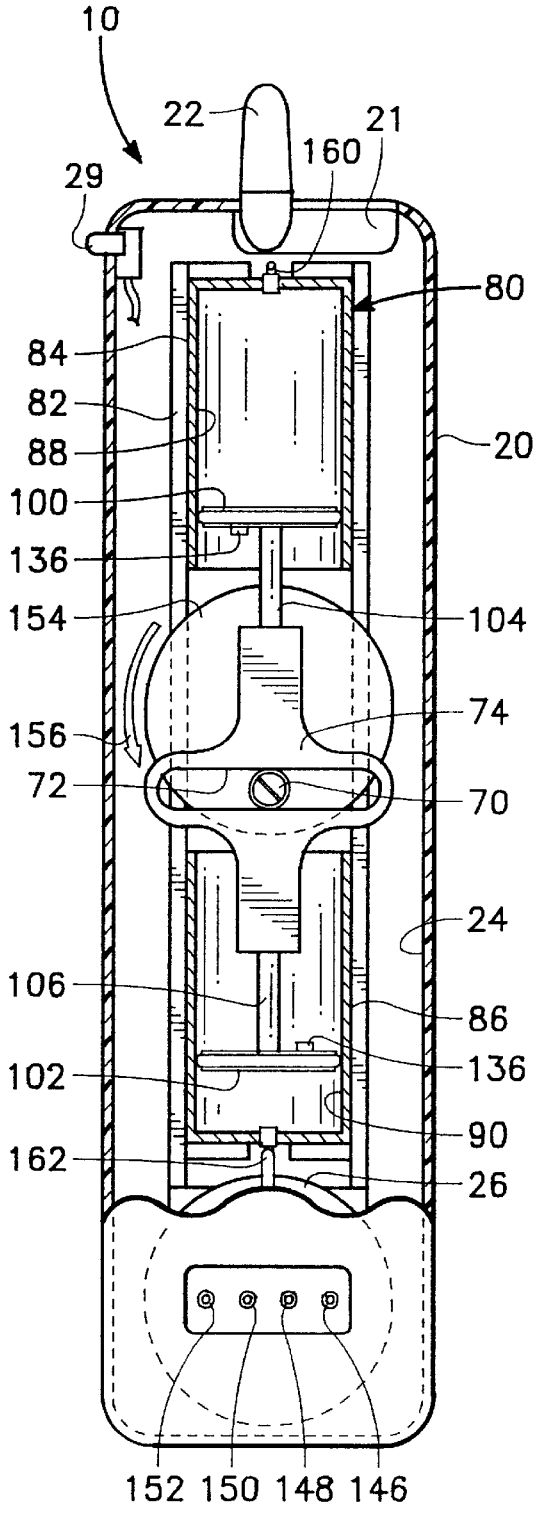
FIG. 2 is a cross-sectional view taken along line 2—2 of FIG. 1 showing an opposed piston unit in a first position.
Figure 3:
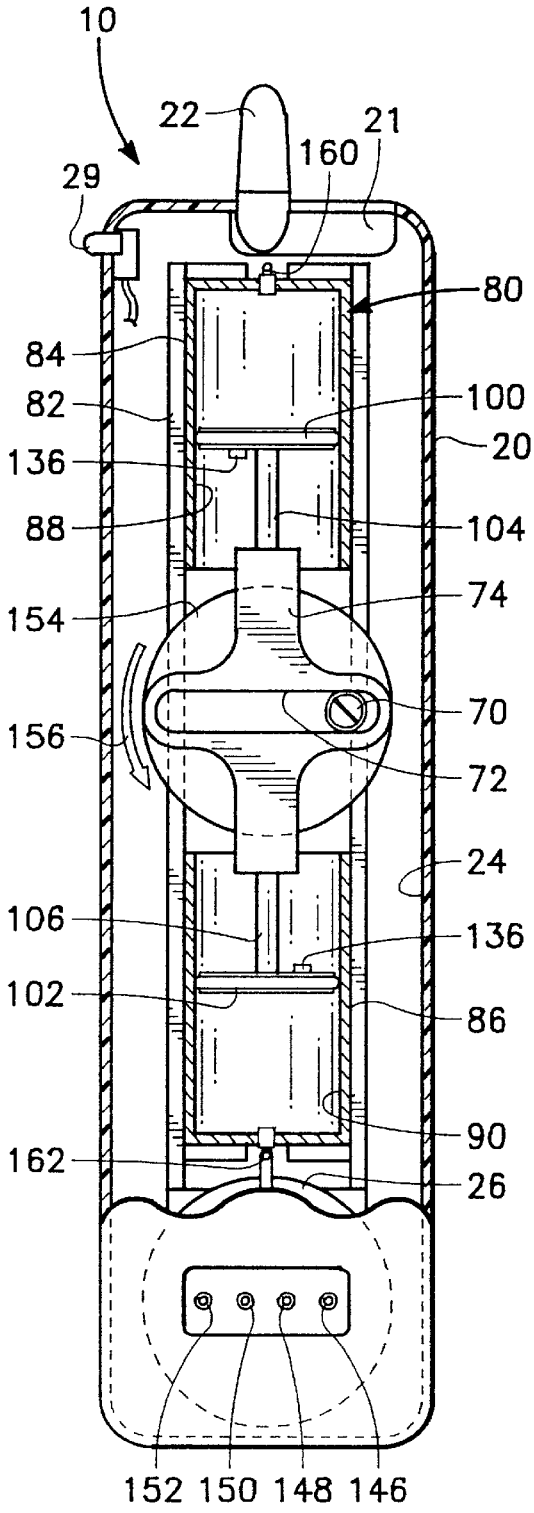
FIG. 3 is a view similar to FIG. 2 but showing the same opposed piston unit in a second position.
Figure 4:
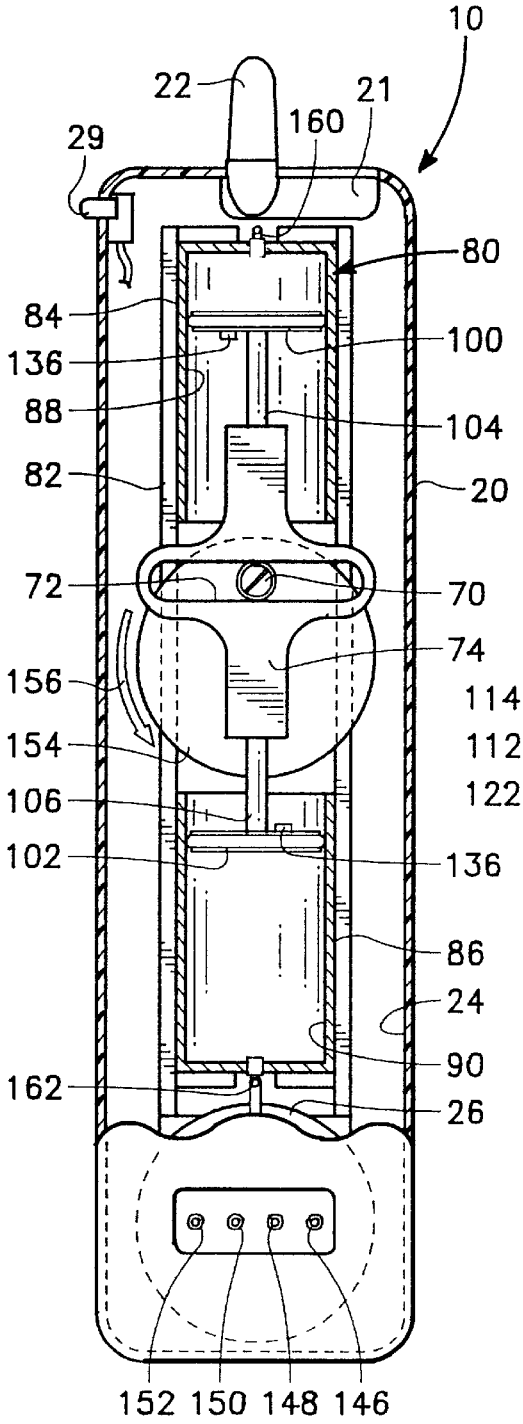
FIG. 4 is a view similar to FIG. 3 but showing the opposed piston unit in a third position.

Referring particularly to FIGS. 2–4, the opposed piston unit 80 shows the piston 100 in the bottom dead center position and the piston 102 in the top dead center position in FIG. 2. From the chamber 90, pressurized air is supplied to connector 146 and a suction is applied from chamber 88 to connector 148. At the same time, a lesser degree of pressurization of air is supplied from internal chamber 98 to connector 150 with an approximately similar degree of pressurization being supplied from internal chamber 96 to connector 152. As the electric motor 26 is driven, the opposed piston units 78 and 80 are driven in a reciprocating manner with unit 80 being ninety degrees out of phase of unit 78. This ninety degree phase relationship is generally preferred as opposed to one hundred eighty degrees out of phase relationship for the reason of evening out the load on the motor. It is to be understood that one hundred eighty degrees out of phase would also provide a good massaging effect and is to be considered within the scope of this invention. Jack shaft 70 is mounted on a wheel 154 which is rotated in the direction of arrow 156 which causes the opposed piston unit 80 to be moved from the position shown in FIG. 2, which is the limit of movement in the downward direction, to an intermediate position shown in FIG. 3 and then to the limit of movement in the upper position shown in FIG. 4. The jack shaft 70 will move entirely throughout the length of the elongated slot 72 for each revolution of the wheel 154.

The internal chamber 88 connects with conduit 160 which connects with the connector 146. Conduit 162 connects with the internal chamber 90 and to connector 148. Conduit 164 connects with the internal chamber 9 6 and to connector 150. Conduit 166 connects with the internal chamber 94 and to connector 152.

Figure 9:
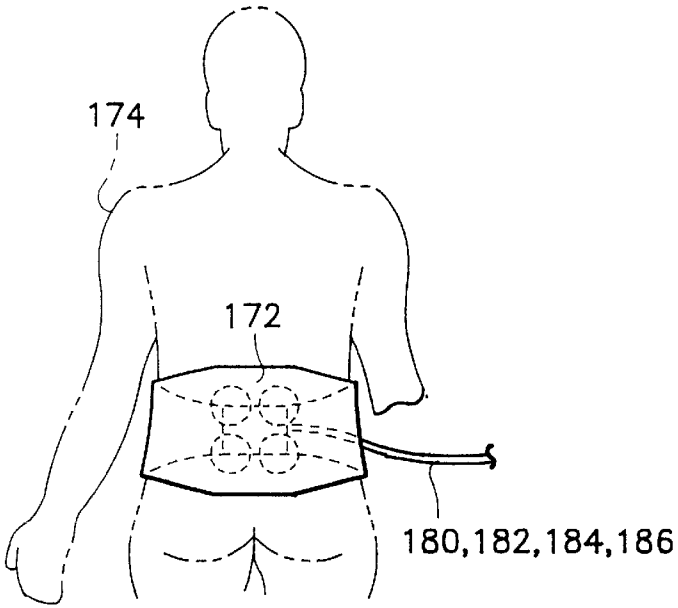
FIG. 9 is a view of a bladder housing which is included within the massaging apparatus of the present invention which is to be applicable to the back area of a human user.
Figure 10:
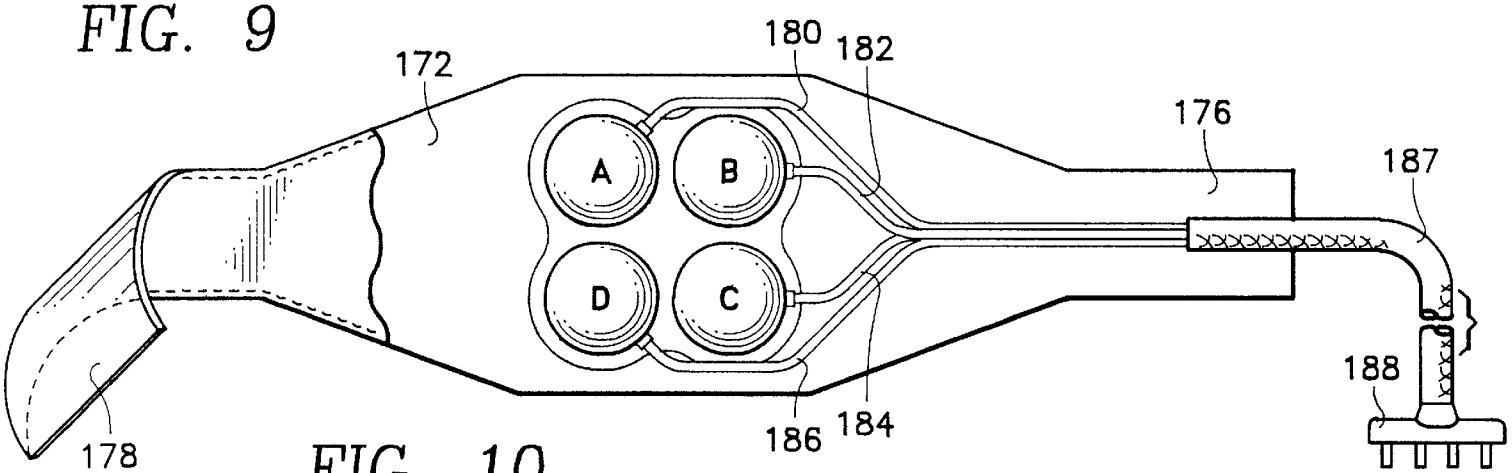
FIG. 10 is a cut-away front view of the inflatable bladder housing showing the inflatable bladders contained within the housing of the embodiment shown in FIG. 9.

Referring particularly to FIGS. 9 and 10, there is shown a flexible wrap housing 172 which is capable of being placed about the body of a human 174. The wrap housing 172 is particularly designed to accommodate to the lower back of the human 174. The wrap housing 172 has ends 176 and 178 which are to be secured together as being connected by a fastener arrangement such as commonly sold under the trademark of Velcro. Included within the housing wrap 172 are bladders A, B, C and D. Each of the bladders are of the same size and are circular in shape although the size of the bladders could vary as well as their shape. Bladder A is connected to conduit 180. Bladder B is connected to conduit 182. Bladder C is connected to conduit 184. Bladder D is connected to conduit 186. Each of the conduits 180, 182, 184 and 186 pass through a shroud 187 and terminate at a connector 188. The connector 188 is to be connectable to connectors 146, 148, 150 and 152. Conduit 180 connects with connector 146, conduit 182 connects with connector 148, conduit 184 connects with connector 150 and conduit 186 connects with connector 152.

Figures 5, 6, 7, 8:
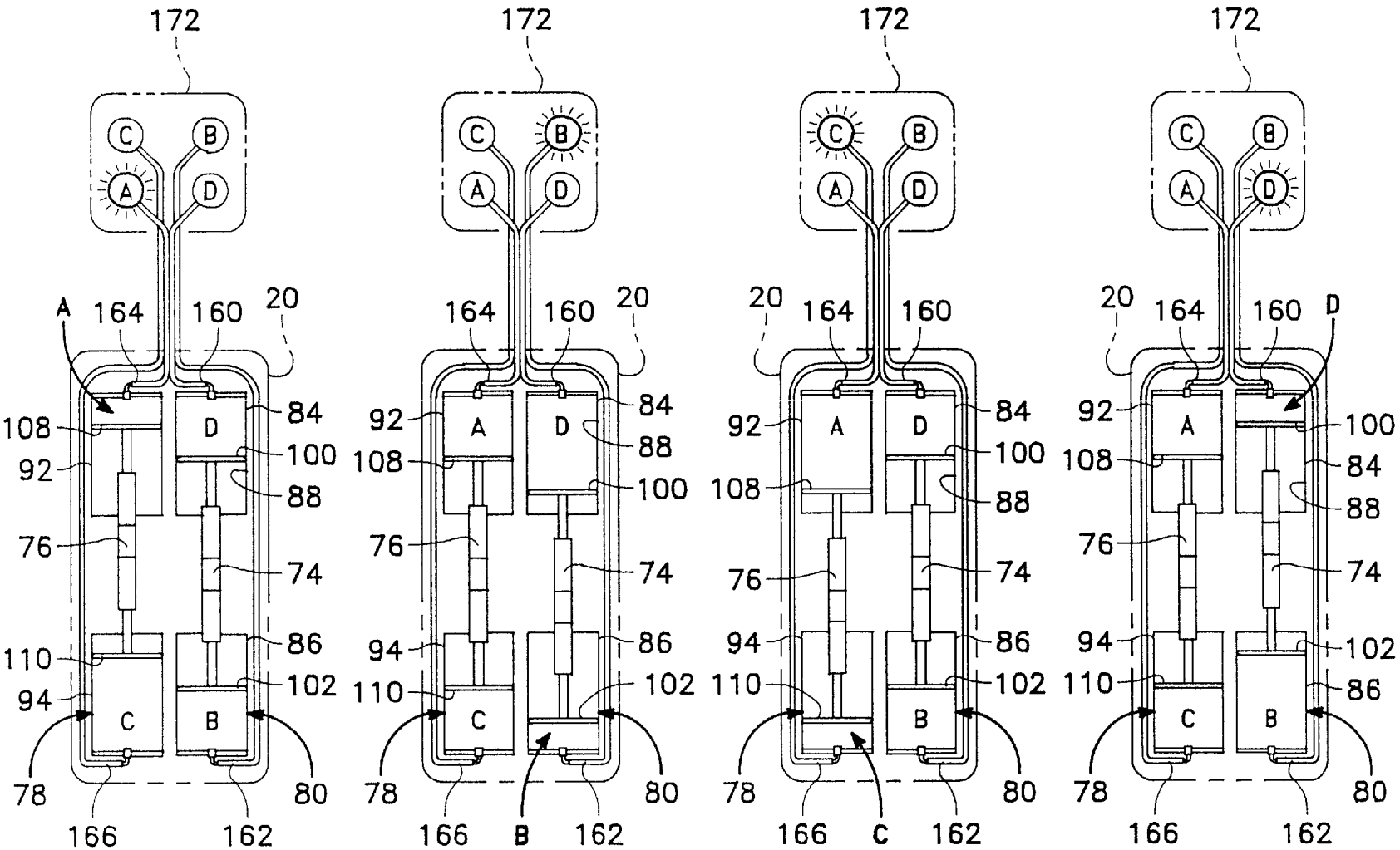
FIG. 5 is a functional schematic view showing the pair of opposed piston units included within the massaging apparatus of the present invention in the position to inflate totally inflatable bladder A of four in number of separate inflatable bladders.
FIG. 6 is a view similar to FIG. 5 but showing the opposed piston assembly in the position to totally inflate inflatable bladder B.
FIG. 7 is a view similar to FIG. 6 but showing the opposed piston assembly in the position to totally inflate inflatable bladder C.
FIG. 8 is a functional schematic view similar to FIG. 7 but showing the opposed piston assembly in the position to totally inflate inflatable bladder D.

Referring particularly to FIGS. 5–8, when the opposed piston units 78 and 80 are in the position shown in FIG. 5, bladder A is being pressurized. The air is being almost entirely removed from bladder C while bladders B and D are each partially pressurized. As the opposed piston units 78 and 80 continue to move, the next bladder that is pressurized is bladder B with bladder D being totally unpressurized and bladders A and C being partially pressurized. This is shown in FIG. 6. Referring particularly to FIG. 7, as the opposed piston assemblies 78 and 80 continue to move, bladder C then becomes completely pressurized with bladder A then being totally unpressurized. Bladders B and D are then partially pressurized. Referring particularly to FIG. 8, bladder D is then totally pressurized with bladder B being completely unpressurized. Bladders A and C are partially pressurized. This sequence continues to repeat itself with pressurization of a particular bladder to occur only for a few seconds which means the same bladder is repressurized about every ten to fifteen seconds.

It is to be understood that valving could be incorporated to change the sequence of inflation. Instead of the inflation sequence of A, B, C and D, the bladders could be sequentially inflated A, D, B and C or A, C, B and D.

Figure 11:
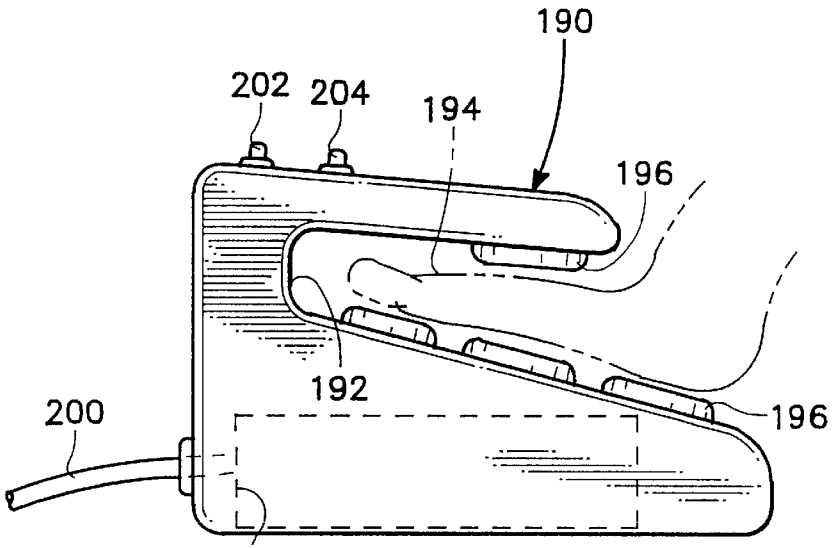
FIG. 11 is a side elevational view of a stand alone massaging apparatus which is to be usable for massaging the feet of a human user.

Referring particularly to FIG. 11, there is shown a foot massager 190. The foot massager 190 is a stand type of unit which includes a compartment 192 into which a human is to insert his or her feet 194. Located in conjunction with the compartment 192 are a plurality of bladders 196 with five in number of such bladders being shown. The bladders 196 are to be inflated and deflated by an opposed piston inflation and deflation apparatus 198 which is mounted within the foot massager 190. Electricity is to be supplied to the apparatus 198 by supply cord 200. Activation of the apparatus 198 is to occur by pressing of power switch 202. There may also be included a source of heat in conjunction with each of the bladders 196. Operation of that heat is by means of activation of switch 204.

Figure 12:
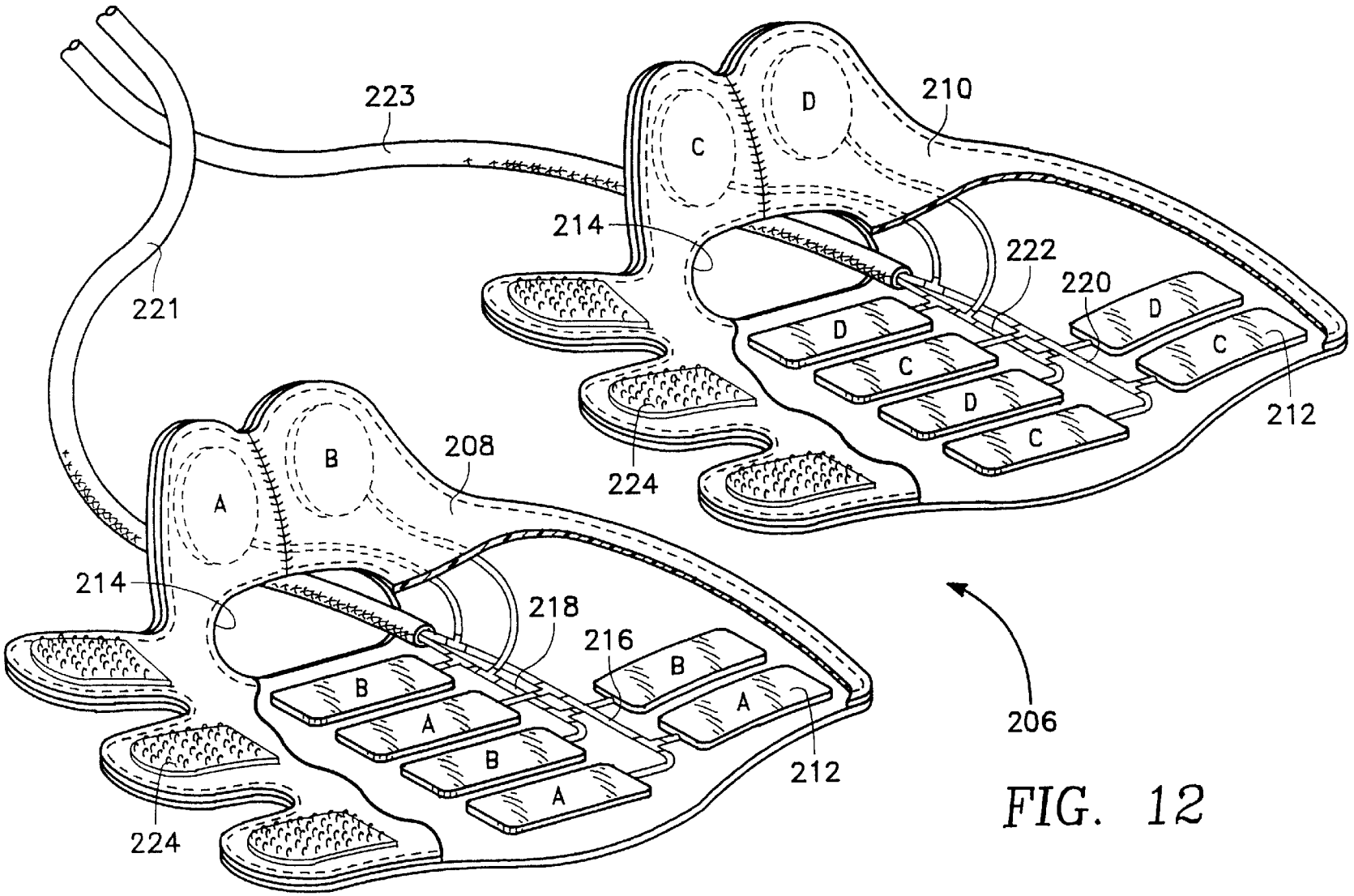
FIG. 12 is an isometric view of a configuration of wrap that is to be placed on the feet of the human user showing the wrap in a partially cut-away view with each wrap including a plurality of inflatable bladders which are to be sequentially inflated and deflated to produce a massaging affect on the foot.
Figure 13:
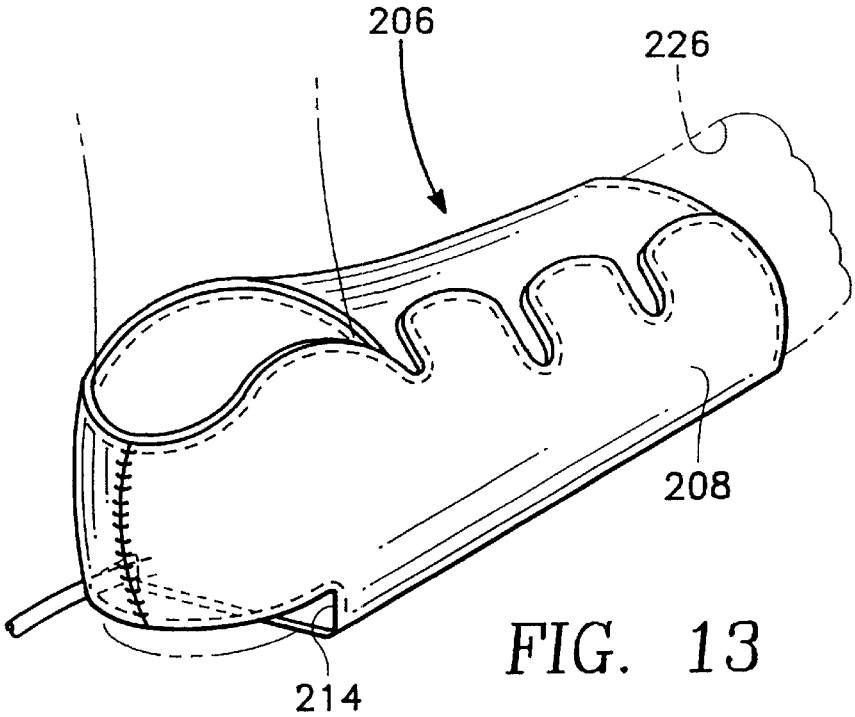
FIG. 13 is an isometric view of one of the wraps shown in FIG. 12 showing it mounted on a human foot.

Referring particularly to FIG. 12, there is shown an embodiment 206 of foot massager which does not comprise the stand type of unit of FIG. 11. The embodiment 206 is shown being mounted on a foot 226 in FIG. 13. The embodiment 206 utilizes two separate wrap housings 208 and 210. The wrap housings 208 and 210 each include a plurality of bladders 212. The bladders 212 within the wrap housing 208 have been assigned numbers A and C with the bladders 212 in the wrap housing 210 being assigned numbers B and D. Each wrap housing 208 and 210 includes a heel opening 214. A conduit 216 is to connect with all the bladders denoted as A. A conduit 218 connects with all the bladders denoted as C. A conduit 220 connects with all the bladders denoted as B. A conduit 222 connects with all the bladders denoted as D. Conduits 216 and 218, after passing through shroud 221, and conduits 220 and 222 after passing through shroud 223 are all to be connected to connectors 146, 148, 150 and 152 respectively.

The user is to place a heel of the foot within heel opening 214 and then the wrap housing 208 is wrapped about the user's foot and secured by fastener pads 224. Wrap housing 208 is to be applied to one foot and wrap housing 210 is to be applied to the other foot with the feet not being shown. Moving of the opposed piston units 78 and 80 will result in connector 146 inflating and deflating all the bladders A while connector 148 inflates and deflates all the bladders B. Connector 150 will cause inflation and deflation of all bladders referenced C and connector 152 will cause inflation and deflation of all bladders referenced D. The displacement volume of the unit must be in proportion to the volume of the bladders to be inflated. In the embodiment shown in FIG. 12, the combined smaller bladders correlate to the output displacement volume of the piston unit. In reference to FIG. 10, the inflation sequence of bladders A, B, C and D is clockwise. The inflation sequence in FIG. 12 is just alternating in conjunction with each foot.

Figure 14:
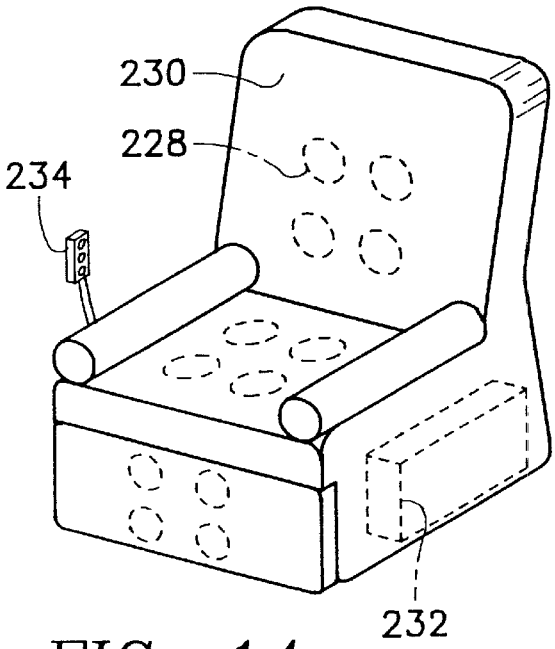
FIG. 14 is an isometric view of a chair within which is incorporated a massaging apparatus of the present invention.

Referring particularly to FIG. 14, a series of bladders 228 could be constructionally formed at the time of manufacture of a chair 230. The opposed piston inflation and deflation apparatus 232 is mounted within the confines of the chair 230. Control of the operation of the apparatus 232 is achieved by means of hand held controller 234.

Figure 15:
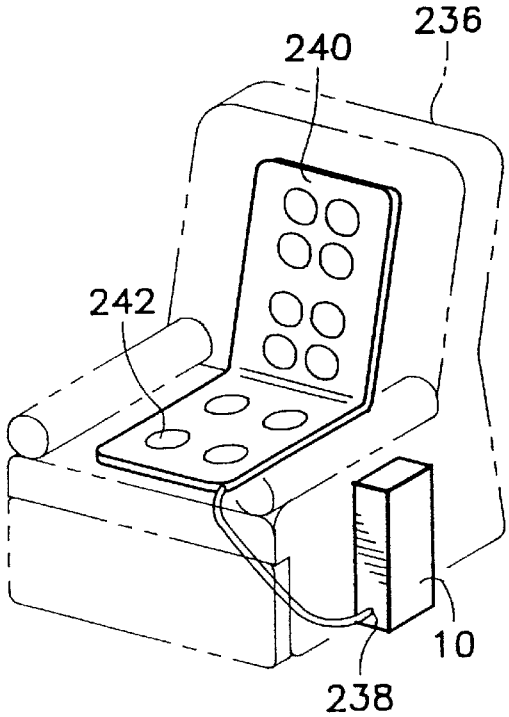
FIG. 15 is an isometric view of a pad which is to be used in conjunction with a typical chair.

Referring particularly to FIG. 15, there could be incorporated with the chair 236 a separate device, such as a housing 20, which connects by tube 238 which carries conduits 160, 162, 164 and 166 to a pad 240. The pad 240 is to include a plurality of bladders 242. The pad 240 is to be flexible so as to set within the seated area of the chair 236. The tube 238 connects the bladders 242 to the opposed piston units 78 and 80 which are mounted within the housing 20.

What is claimed is:

1. A massaging apparatus comprising:

a plurality of inflatable and deflatable bladders; and inflation means connected to said plurality of said bladders, said inflation means to sequentially inflate and deflate said bladders, said inflation means comprising an opposed piston assembly having a first piston and a second piston, whereby said first piston inflates one of said bladders and simultaneously said second piston deflates another said bladder, said opposed piston assembly comprises a pair of opposed piston units "with each of said units having a first piston and a second piston, said units being" has been added after mounted so that their cycles are staggered.

2. The massaging apparatus of claim 1 further comprises a housing, said bladders being mounted on said housing, said housing is constructed of a flexible material, said housing being designed to be contacted with a portion of a user's body.

3. The massaging apparatus of claim 1 wherein said housing is designed to be wrappable and securable about a portion of a user's body.

4. The massaging apparatus of claim 1 further comprising a pressure relief device for preventing the over inflation of said bladders, said pressure relief device being connected to said opposed piston assembly.

5. The massaging apparatus of claim 4 further comprising a first pressure relief device being connected to said first piston and a second pressure relief device being connected to said second piston.

6. The massaging apparatus of claim 1 wherein said pair of opposed piston units are mounted ninety degrees out of phase.

7. A massaging apparatus comprising:

a plurality of inflatable and deflatable bladders; and inflation means connected to said bladders, said inflation means including at least one opposed piston assembly including a first piston and a second piston, whereby as said first piston inflates one of said bladders said second piston deflates another bladder of said bladders, both said first piston and said second piston having a crank arm situated between said first piston and said second piston, said crank arm being connected by a connection to a drive system.

8. The massaging apparatus of claim 7 wherein the connection of said drive system is an elongated slot.

9. The massaging apparatus of claim 7 wherein the connection to said drive system is located on said crank arm.

10. The massaging apparatus of claim 7 further comprising a motor, said motor being designed to operate said inflation means.

11. The massaging apparatus of claim 7 wherein each bladder of said bladders is constructed of a flexible material, each of said bladders being designed to be contacted with a portion of a user's body.

12. The massaging apparatus of claim 7 further comprises a housing, said bladders being mounted on said housing, said housing is constructed of a flexible material, said housing being designed to be contacted with a portion of a user's body.

13. The massaging apparatus of claim 7 further comprising a pressure relief device for preventing the over inflation of said bladders, said pressure relief device being connected to said opposed piston assembly.

* * * * *